US006951308B2

(12) United States Patent
Bucceri

(10) Patent No.: US 6,951,308 B2
(45) Date of Patent: Oct. 4, 2005

(54) SNOW MAKING METHOD AND APPARATUS

(75) Inventor: Alfio Bucceri, Newmarket (AU)

(73) Assignee: Snow Factories SA, Brussels (BE)

( * ) Notice: Subject to any disclaimer, the term of this patent is extended or adjusted under 35 U.S.C. 154(b) by 211 days.

(21) Appl. No.: 10/415,792

(22) PCT Filed: Nov. 5, 2001

(86) PCT No.: PCT/AU01/01419

§ 371 (c)(1),
(2), (4) Date: Sep. 15, 2003

(87) PCT Pub. No.: WO02/37039

PCT Pub. Date: May 10, 2002

(65) Prior Publication Data

US 2004/0060995 A1 Apr. 1, 2004

(30) Foreign Application Priority Data

Nov. 6, 2000 (AU) ..... PR1228

(51) Int. Cl.[7] ..... F25C 3/04; B05B 1/24

(52) U.S. Cl. ..... 239/2.2; 239/14.2; 239/128; 239/132; 239/132.1; 239/132.3; 239/139

(58) Field of Search ..... 239/2.2, 14.2, 239/128, 132, 132.1, 132.3, 139

(56) References Cited

U.S. PATENT DOCUMENTS

| | | | | |
|---|---|---|---|---|
| 5,289,973 A * | 3/1994 | French | ..... | 239/14.2 |
| 5,297,731 A | 3/1994 | Bucceri | ..... | 239/14.2 |
| 6,454,182 B1 * | 9/2002 | Bucceri | ..... | 239/14.2 |

FOREIGN PATENT DOCUMENTS

| | | |
|---|---|---|
| WO | 9110104 | 7/1991 |
| WO | 9956067 | 11/1999 |

* cited by examiner

*Primary Examiner*—Davis Hwu
(74) *Attorney, Agent, or Firm*—Baker Botts LLP

(57) ABSTRACT

A snow making method and apparatus wherein water (3) in flexible hoses (2), within a cooling medium (1) is converted to snow and/or ice crystals. The hoses (2) are cyclically inflated and deflated to cause the crystals to be dislodged from the inner wall surfaces of the hoses (2). When the hoses (2) are full of crystals, the crystals can be discharged by pumping or blowing.

29 Claims, 6 Drawing Sheets

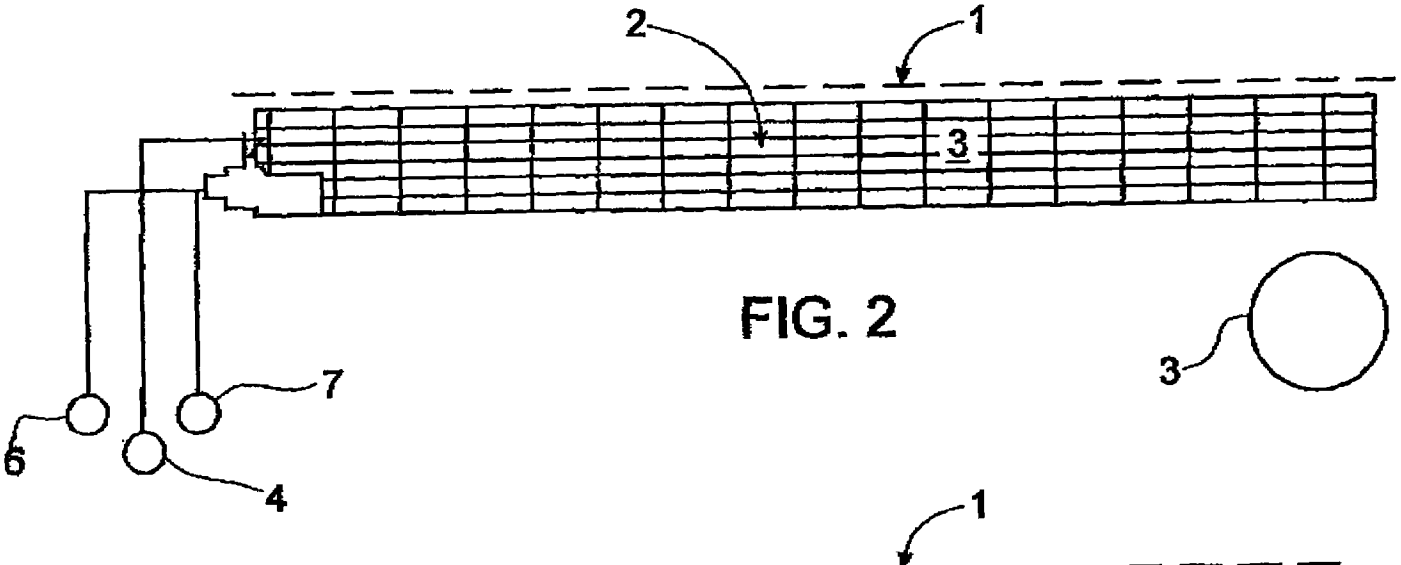
FIG. 2
FIG. 2a
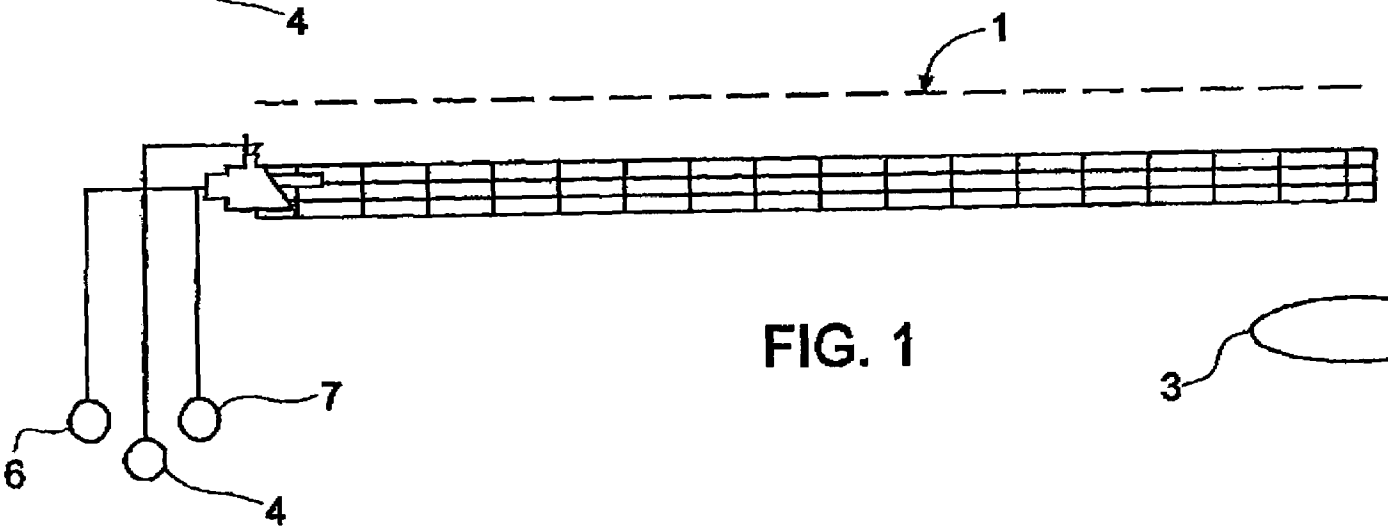
FIG. 1
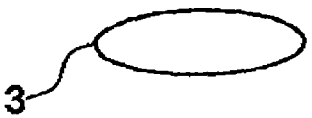
FIG. 1a

SNOW MAKING METHOD AND APPARATUS

BACKGROUND OF THE INVENTION

1. Field of the Invention

THIS INVENTION relates to a snow making method and apparatus.

The invention particularly relates, but is not limited to, an improved snow making method, and apparatus therefor, for making man-made snow and ice crystals, to be used for covering skiing slopes with man-made snow; for Indoor ski centres; and for the commercial issue of ice or domestic or cooling requirements.

2. Prior Art

U.S. Pat. No. 5,297,731 (Aiflo Bucceri) disclosed a snow making technique and apparatus where ice crystals were formed within multiple hoses and were dislodged by passing a roller mechanism over the hoses. The machinery was limited to a particular area of snow production only, being bulky and difficult to move around the field. As well, the machine could not be easily used on an unprepared or rough ground. The coolant requirement was high, and one leak could lead to a costly replacement. The machines could not be economically produced in bulk supply, due to the many man hours required to produce the machine. The method of dislodging the ice crystals could cause machinery downtime, due to the fact that one roller mechanism was working on multiple hoses. Therefore, if one hose failed, all the other hoses were non-productive while repairs were effected. In addition, the end product was sometimes too wet for immediate use and required further drainage, and the hoses were limited to short lengths due to the complexity of the machinery.

International Patent Application PCT/AU99/00312 (International Publication No WO 99/56067) (Alfio Bucceri) disclosed a snow making machine having at least one flexible hose assembly, with an inner hose connected to a water supply and an outer jacket to receive coolant from a chiller. Ice/snow formed in the inner hose was dislodged by inflating squasher hoses in the outer jacket, and pressurized air fed via a line to the inner hose could assist transport of the dry snow crystals to the end of the hose assembly. In one embodiment, the hose assemblies are deformed using a pair of rollers which travel in concert along rails to release the ice formed on the walls of the inner hoses.

The disadvantages of the method and apparatus of PCT/AU99/00312 included the necessity to have up to three hoses within the outer jacket, ie., the inner hose, the squasher hose, and the pressurized air hose; and that the wall thicknesses of both the inner hoses and outer jackets must be relatively thick to withstand the deformation by the roller assemblies —the thickness of the inner hoses, in particular, reducing the rate of heat transfer from the coolant in the outer jackets to the water in the inner hoses.

SUMMARY OF THE PRESENT INVENTION

It is an object of the present invention to provide an improved method for making man-made snow and/or ice crystals, which is simpler than the method disclosed in International Patent Application PCT/AU099/00312.

It is a preferred object of the present invention to provide a method that can be used in any climatic conditions, without the requirement of low temperatures and/or low air humidity.

It is a further preferred object of the present invention to provide a method with improved heat transfer from the cooling medium to the water (or water-based mixture) from which the snow and ice crystals are formed.

It is a still further preferred object of the present invention to provide a method which uses less water, thereby allowing for all the water introduced in the hoses to be converted into snow or ice crystals at a much faster rate.

It is a still further preferred object of the present invention to provide a method where the damage to the hoses is minimised by eliminating, or minimising, the number of moving parts.

It is a still further preferred object of the present invention to provide an apparatus, to effect the method, where the cost of fabrication and assembly is greatly reduced.

Other preferred objects of the present invention will become apparent from the following description.

Throughout the specification, the term "hoses" shall be used to include one or more hose, pipe, tube, conduit or the like; where the hoses preferably have outer walls comprising, or constructed of, resiliently flexible material(s).

Throughout the specification, the term "water" shall include water or water/surfactant mixtures or the like. (Suitable surfactants include "SNOWFOAME" and "FXSnow" (Trade Marks).

In one aspect the present invention resides in a snow making method including the steps of:

(a) locating hoses, in an at least partially collapsed state, in a cooling medium;

(b) at least partially filling the hoses with water to allow heat transfer from the water to the cooling medium to generate snow and/or ice crystals in the hoses;

(c) applying an inflating force to the hoses to cause the hoses to be at least partially expanded, thereby releasing the snow and/or ice crystals from inner wall surfaces of the hoses;

(d) reducing the inflating force to allow further generation of the snow and/or ice crystals in the hoses;

(e) repeating steps (c) and (d) until at least substantially all the water in the hoses has been converted to snow and/or ice crystals; and (f) discharging the snow and/or ice crystals from the hoses to enable the method to be repeated.

Preferably steps (c) and (d) are effected at a cycle rate dependent on the rate of generation of the snow and/or ice crystals in the hoses.

Preferably the steps (c) and (d) are effected continuously to cause continuous movement of the wall surfaces of the hoses.

Preferably the cooling medium is ambient air, or a liquid (eg., brine or actuator/glycol mixture), which is preferably maintained at, or below, a preset temperature, by passing the cooling medium through a refrigeration apparatus, or through a heat exchanger operably connected to a refrigeration apparatus.

Preferably step (c) is effected by the introduction of compressed air into the hoses and step (d) is effected by bleeding, or releasing, the air from the hoses. Preferably the introduction into, and bleeding from, the compressed air to the hoses is effected by valve means, which is preferably controlled by computerised or like timing means.

Preferably step (f) is effected by releasing clamping or sealing means applied to one end of the hoses and the introduction of compressed air to the other end of the hoses, the compressed air assisting the transport of the snow and/or ice crystals to, and through, the one end of the hoses.

In a second aspect, the present invention resides in snow making apparatus, including:

a cooling medium in a containment vessel;

a plurality of hoses, at least partially filled with water;

means to apply an at least intermittent or cyclable inflating force to the hoses to cause the hoses to be at least partially inflated and deflated; and means to discharge snow and/or ice crystals generated in the hoses; wherein:

heat transfer from the water to the cooling medium generates snow and/or ice crystals in the hoses; and the at least partial expansion of the hoses by the inflating force releases the snow and/or ice crystals from the inner wall surface of the hoses.

Preferably, the containment vessel is a tank, with preferably insulated side walls, end walls, floor and optional removable lid or cover.

Preferably, the cooling medium is air or a liquid, preferably brine or a water/glycol mixture.

Preferably, the hoses are constituted of material(s) which are water impervious, flexible, inflatable and capable of remaining pliable at low temperatures. Preferably, the hoses have a smooth inner liner constituted of material such as Teflon™, polyurethane, nylon or like plastics or rubber materials resistant to ice formation, and may be coated with a non-stick coating such as linseed oil.

Preferably, protective outer layers of the hoses are constructed of flexible material or fibres, Including thin-walled polypropylene, plastic, fabric or metal fibres. (Depending on the selection of the material(s) for the inner liner, the outer layer may be omitted for improved heat transfer between the water in the hoses and the cooling medium.)

Preferably, the hoses are contained within a cage or superimposed tanks to maintain the hoses in heat-transfer contact within the cooling medium.

Preferably, the means to at least partially inflate the hoses include a compressed air supply, a liquid pump or a vacuum pump; and a valve means, preferably connected to a control system, to enable the hoses to be inflated and deflated in a predetermined cycle.

Preferably; the means to discharge the snow and/or ice crystals from the hoses include compressed air, pump means and/or gravity.

Preferably, releasable sealing means operably close one end of the hoses. Preferably, the sealing means include clamping means, on a retractable cylinder, externally engageable with the hose, a shut-off valve or inflated bladder means within the hoses.

BRIEF DESCRIPTION OF THE DRAWINGS

To enable the invention to be fully understood, preferred embodiments will now be described with reference to the accompanying drawings in which:

FIG. 1 is a schematic side view of the apparatus for the method where the hoses are collapsed/deflated;

FIG. 2 is a similar view of the apparatus where the hoses are expanded/inflated;

FIGS. 1*a* and 2*a* are respective end views of one of the hoses in its respective collapsed/deflated and expanded/inflated configuration;

DETAILED DESCRIPTION OF THE PREFERRED EMBODIMENTS

Figure 3:
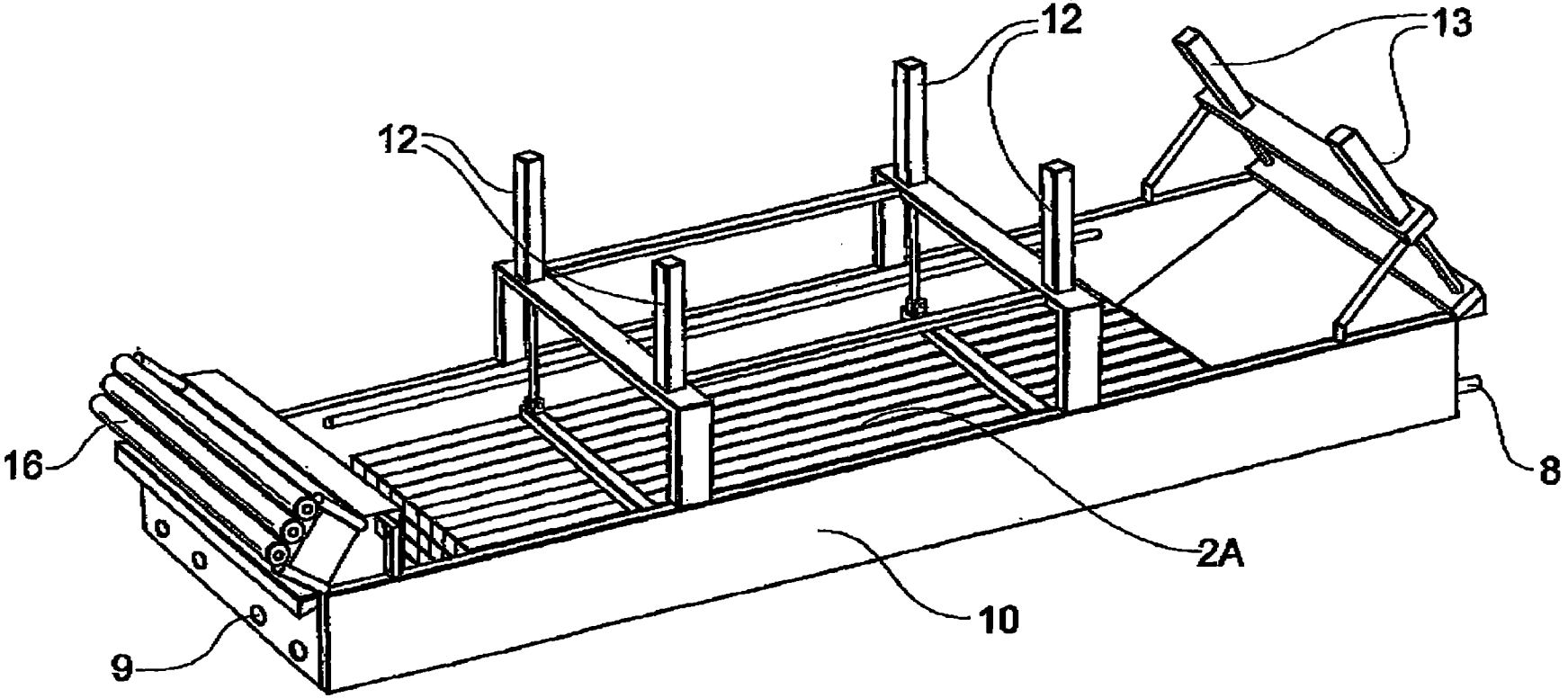
FIG. 3 is a perspective view of a first embodiment of the apparatus in effecting the method, parts being omitted for clarity.

Referring now to FIGS. 1, 1*a*, 2 and 2*a*, the operation of the invention will now be broadly described.

A liquid cooling medium (eg., brine) (or air) 1 is contained within a suitable containment vessel, eg., an open-top tank. The cooling medium 1 is created by below freezing ambient air temperature, a heat pump, a refrigeration apparatus or the like—the cooling medium 1 may be passed through a heat exchanger cooled by a refrigeration apparatus.

Water 3 at least partially fills the hoses 2, the hoses 2 preferably being arranged in a matrix to allow intimate contact between the outer surfaces of the hoses 2 and the cooling medium 1.

The hoses 2 are constructed of materials which are water-impervious, are flexible, inflatable and capable of remaining pliable at low temperatures.

Snow is formed by the transfer of heat from the water 3 in the hoses 2 to the cooling medium 1. Ice crystals begin to form on the inner wall surfaces of the hoses 2 and/or in the water 3 due to the mechanical manipulation of the hoses and the below-freezing temperature of the cooling medium 1.

The mechanical manipulation of the hoses 2 causes the ice crystals on the inner wall surfaces of the hoses 2 to be repeatedly dislodged, mechanical manipulation being effected by the cyclic increasing and decreasing of the pressure in the hoses 2. The mechanical manipulation causes the continuous movement of the walls of the hoses 2 which, when combined with the non-stick nature the inner wall surfaces of the hoses 2, allow for the generation or formation of millions of uniform snow crystals.

The mechanical manipulation means 4 can be any method for altering the pressure in the hoses and may include the following:

a compressed air supply which is operated on a cycle to inflate and deflate the hoses;

a pump, preferably a diaphragm pump without a non-return valve, that operates on a cycle to fill and drain the hoses continuously;

a vacuum pump which operates on a cycle to constantly reduce and increase the air pressure above the fluid lines; or a blower, or similar hydraulic force, capable of intermittent use which creates constant movement and deformation of the walls of the hoses.

FIGS. 1*a* and 2*a* are schematic end views of the hoses and illustrate examples of the shapes when deflated and inflated, respectively.

Preferably, the hoses 2 have inner layers made from the material such as flexible Teflon™, polyurethane, nylon or similar plastics or rubber materials which are resilient to ice formation on the walls. The inner wall surfaces can be treated with a non-stick costing, which is linseed oil. The outer layer(s) of the hoses 2 can be any flexible material or fibres capable of high heat transfer and having an ability to withstand the 7 psi/210 kpa—suitable construction materials for the outer layers of the hoses 2 includes thin-walled polypropylene, plastic, fabric or metal fibres.

Alternatively, proprietary material such as laid flat hoses can be used.

After a set period of time, all of the water in the hoses 2 will be converted into ice crystals. The time will vary and depend on the introduced temperature of the water, the type and temperature of the cooling medium 1, the type of mechanical manipulation used, the materials for the inner liner and outer layer of the hoses, etc.

When the time has expired, the snow formed within the hoses can be blown out by compressed air 6, or be sucked from the hoses by means of a pump (or flow under gravity), to a point of use or storage.

The hoses 2 are then re-filled with water 3 by a pump 7 and the process is repeated until such time as the desired quantity of snow is produced.

The total snow making process can be controlled by a DDC or programmable logic controller which monitors the total operation of the system in use.

Figure 4:
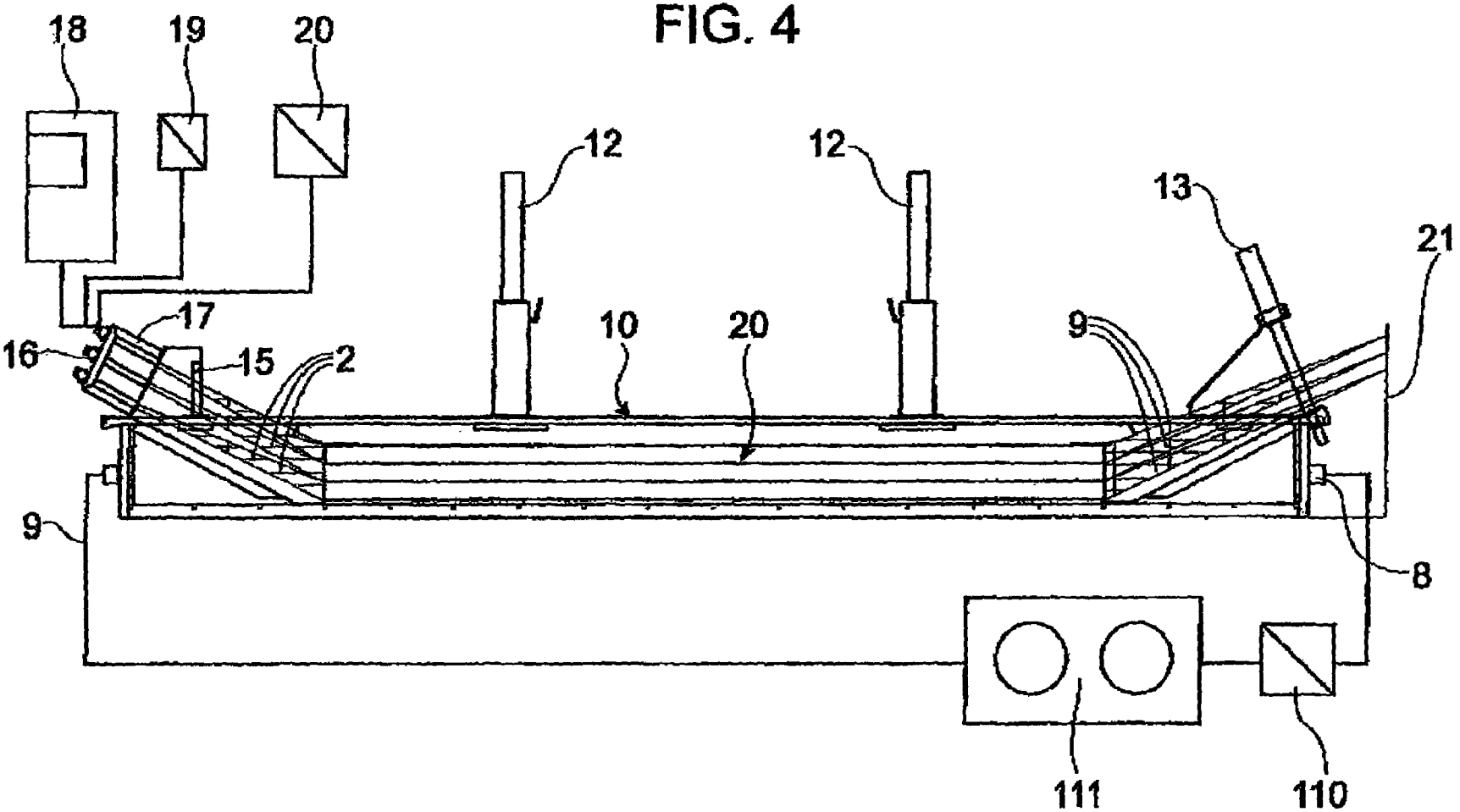
FIG. 4 is a schematic side view of the apparatus of FIG. 3, with ancillary equipment being shown in block form.

The method will now be described in more detail with reference to FIGS. 3 and 4, which illustrate a snow making machine having thirty-six (36) snow hoses 2 operating as described above. The snow hoses 2 can be prefabricated of any size and are configured in three levels with the twelve hoses in each level constructed as hereinbefore described. Compressed air is employed for the manipulation of the hoses 2 in this example.

Cooling medium 1 is contained within an open top tank 10 made of stainless steel, aluminium, galvanised iron or other material suitable for holding water; the walls, removable lid(s) and base of the tank are preferably insulated. A rectangular cage 2A comprises 36 rectangular stainless steel partitions, although these can also be of square or oval configuration. The partitions 2A are capable of keeping the hoses 2 in position, and maintaining the hoses 2 to below the level of the cooling medium 1, which is constantly maintained at low temperature and re-cycled through the tank 10.

The cooling medium is a water and anti-freeze mixture (eg., brine or water/glycol), which is pumped to the tank by a pump 10 by a pump 111. The cooling medium 1 is cooled to sub-freezing temperatures by either a heat exchanger utilising the natural ambient conditions or a mechanical heat pump 110. The cooling medium 1 is pumped to the tank 10 through inlets 8 and leaves the tank via outlets 9 and the level of the cooling medium 1 is maintained so as to cover the top of the cage a where the hoses 2 are positioned in three layers.

Lifting cylinders 12 are connected to the cage 2A by way of lifting lugs. The hoses 2 contained in the cage 2A can be lifted from the tank 10 above the cooling medium by the lifting cylinders 12 for maintenance or when the system is not in use.

A retractable cylinder 13, at one end of the tank 10, is operable to seal an end of the hoses 2 by downward pressure so that air can be injected into the hoses 2 by opening a solenoid 17, which is connected to a receiver of compressed air 20 which is used to inflate and deform the hoses 2 to make the ice crystals. The pressurised air escapes and the hoses 2 return to their normal (deflated) elliptical position (see FIG. 1*a*), when the retractable cylinder 13 is retracted from the hoses 2 and the solenoid valve 17 is closed.

A manifold assembly 15 consists of three manifolds and three solenoid valves for each hose 2. The solenoid valves 17 can be electrically operated and are connected to a PLC controller 18, which is programmed to operate the system. The solenoid valves 17 are connected to the manifolds which, in turn, are connected to a compressed air receiver 20 and a water pump 19 connected to a water supply. The introduction of compressed air and water into the hoses 2 is controlled to make the ice crystals hereinbefore described with reference to FIGS. 1 and 2.

The hoses 2 are connected by hose clamps to a series of hose tails on a manifold 21 from which the snow is expelled.

Figure 5:
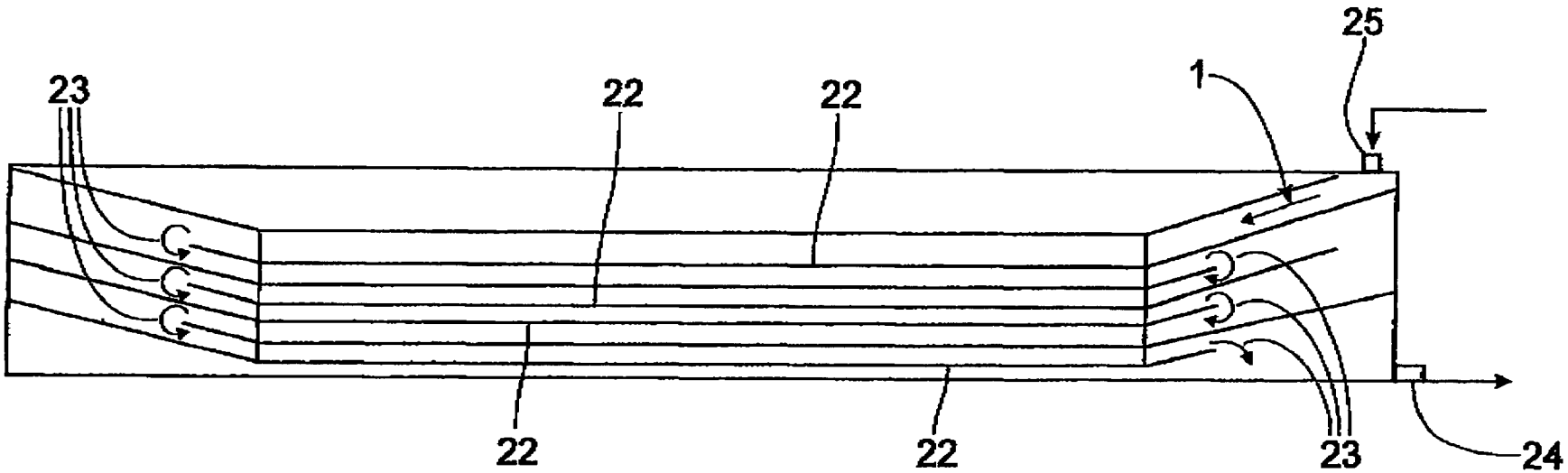
FIG. 5 is a view corresponding to FIG. 3 of the second embodiment of the apparatus.

In an alternative embodiment in FIG. 5, the machine consists of a series of tanks fabricated from aluminium, steel or plastic built to fit neatly on top of each other. They are placed on top of each other in a manner to allow a snow making machine of indefinite height.

The tanks 22 are manufactured in similar proportions and each contain one level of the rectangular partitions which separate and contain the snow making hoses 2. Any number of tanks can be placed on top of each other. The tanks are designed to allow the below freezing cooling medium 1 to cascade, in a flow path indicated by arrows 23, into the tank immediately below it, until it is collected at the lowest tank. When the below freezing cooling medium is in the bottom tank, it is pumped from outlet 24 to a chiller to be cooled again and recycled through the snow making machine via inlet 25 positioned at the top of the machine. Snow is made utilising the same components and method of operation as hereinbefore described. Preferably, the outside of the machine is clad in insulation to minimise the losses from the cooling medium 1 to the atmosphere.

Figure 6:
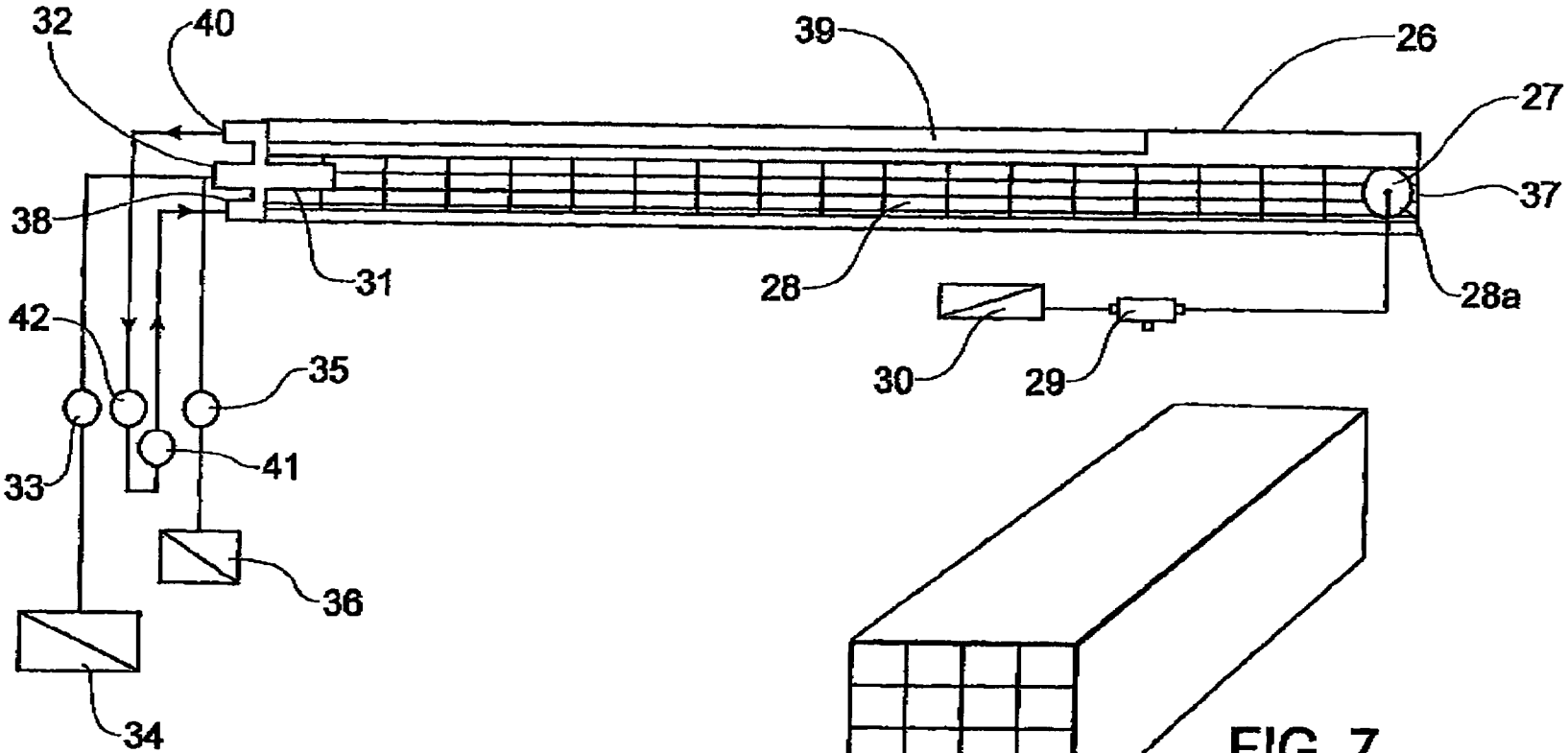
FIG. 6 is a similar view of a third embodiment of the apparatus.

FIG. 6 illustrates a third embodiment of the invention in the form of a single unit, self-contained, variable length snow making machine with an inbuilt hose sealing apparatus. The machine comprises one outer rectangular metal section made of high density plastic or metal material which can be covered in insulated cladding. One or more snow making hoses 28 are contained in a length of the metal outer tubing section 26.

The snow making hoses have a novel bulk-in inflatable rubber hose sealing device 27 located in the end of the snow hoses to allow for the sealing of the end of the snow hoses. An example of a snow hose and sealing device is shown in more detail in FIG. 8.

Alternative expandable rubber or plastic materials can be used to seal the hoses. The sealing device 27 is connected by fitting 28 to a PLC controlled venturi-type vacuum/air valve 29 connected to a compressed air supply 30 that will deflate the hose 28 by vacuum and inflate the hose 28 by introducing compressed air. The supply and of the snow hose 28 is connected by a hose tall 31 and fittings 32 to a solenoid valve 33 which is connected to a compressed air supply 34 for the introduction of compressed air for both manipulation of the hose 28 and snow evacuation; and also to a solenoid valve 35 which is connected to a water pump 36 for introduction of the snow making water. Both ends of the apparatus are sealed except for the snow hose opening 37 and the below-freezing cooling medium 1 is introduced through inlet 38 and connected at a higher level in a diagonal position by the inner tube 39 made of plastic or metal. The below freezing cooling medium 1, pumped through the system to make snow, is drained through the tube 29 via outlet 40 and transferred and recycled through a refrigeration chiller 41 by a pump 42.

Figure 7:
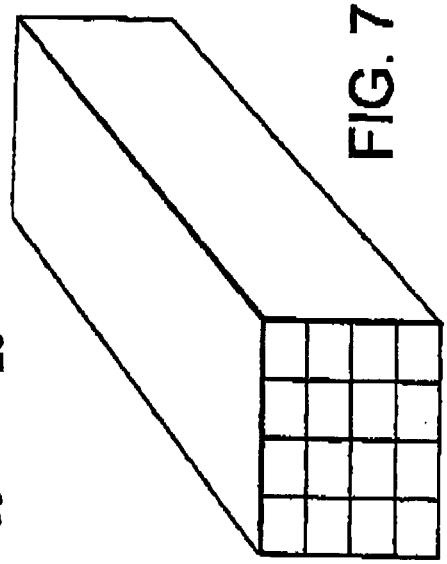
FIG. 7 is a schematic perspective view of the hoses (or tubes) for a fourth embodiment.

FIG. 7 is a general illustration of a 16-hose portable snow making machine where sixteen of the rectangular tubes described in FIG. 6 are stacked onto each other to form a small machine capable of home use. Conversely, the length of the tube could be stacked with lengths of up to 100 meters and in a multiple configurations of rows and layers to form very large snow making machine.

Figure 8:
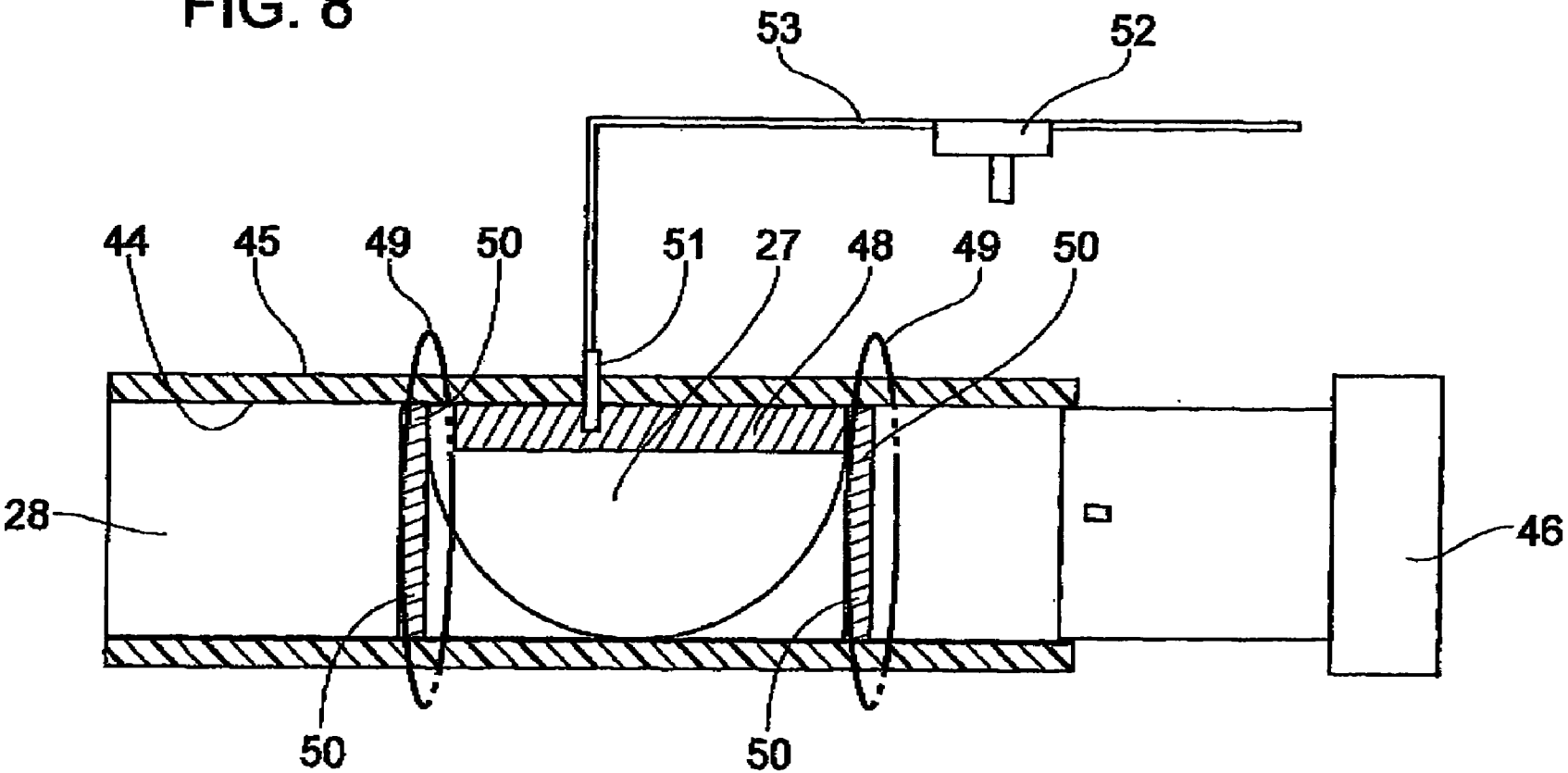
FIG. 8 is a schematic sectional side view of a hose and sealing device.

Referring to FIG. 8, the snow hose 28 and sealing device 27 built into the hose 28 capable of shutting and closing the hose 28 through the compressed air supply will now be described in more detail.

The snow hose 28 is shown with an inner, non-stick liner 44 and outer, pressure-resistant liner 45 forming the hose. A hose tall 46 with appropriate fittings can be fitted to both ends of the hose. The inflatable sealing bladder or tube 27 is of slightly larger diameter than the hose 28 when fully inflated in the hose. When deflated, the sealing bladder 27 retracts into the upper wall of the hose to ensure that no blockage can then occur. The sealing bladder can be prefabricated into the well of the hose by gluing or welding to the inner liner 44 or can be clamped into position by the hose clamps 49 that secure both tubes to the inner metal ring 50. Alternatively, the sealing bladder 27 can be built into the hose tail 46 and then connected to the end of the snow making hose 28 for use. The sealing bladder 27 has a valve 51 secured in position and is connected with tubing to a compressed air fitting that deflates the bladder 27 as needed in the snow making process.

It will be readily apparent to the skilled addressee that the method and apparatus of the present invention enables the efficient, economic manufacture of snow and/or ice crystals, which are suitable for a wide range of applications. The mechanical manipulation of the hoses ensures that the ice crystals are dislodged from the inner wall surfaces of the hoses and the snow and ice crystals can be discharged from the hoses when all of the water in the hoses has been converted to crystals.

Various changes and modifications may be made to the embodiments described and illustrated without departing from the present invention.

What is claimed is:

1. Snow making apparatus, comprising:

at least one inflatable structure comprising a wall having an inner surface and an outer surface, wherein the outer surface is in contact with a coolant, and wherein the at least one inflatable structure holds a quantity of water for conversion into snow by heat transfer through the wall to the coolant in contact with the outer surface, means for applying an inflating force to the at least one inflatable structure to cause the at least one inflatable structure to be at least partially inflated, whereby snow attached to the inner surfaces is dislodged; and means to discharge snow from the inflatable structure.

2. The snow making apparatus of claim 1, wherein the means for applying an inflating force comprises air supply means operable to supply a fluid comprising substantially air to the interior of the at least one inflatable structure to cause the at least one inflatable structure to be inflated and deflated.

3. The snow making apparatus of claim 2 wherein the air supply means is operable to supply fluid cyclically or intermittently.

4. The snow making apparatus of claim 1, further comprising a vessel containing the coolant.

5. The apparatus of claim 4, wherein the vessel is tank having at least one insulated wall.

6. The apparatus of claim 1, wherein the coolant is air.

7. The apparatus of claim 1, wherein the coolant is a liquid.

8. The apparatus of claim 1, wherein the inflatable structure comprises a hose structure.

9. The apparatus of claim 1, wherein the inflatable structure comprises water-impervious material that is flexible and pliable at low temperatures.

10. The apparatus of claim 1, wherein the inflatable structure comprises inner liner material selected from the group of Teflon, polyurethane, nylon, plastic materials, rubber materials, non-stick coatings, linseed oil and any combination thereof.

11. The apparatus of claim 1, further comprising a cage disposed about the inflatable structure to hold the latter in heat-transfer contact within the coolant.

12. The apparatus of claim 1, wherein the means for applying an inflating force comprises:

a compressed-air supply;

a pump; and a valve connected to a control system, wherein the control system operates the valve to inflate and deflate the inflatable structure in a predetermined cycle.

13. The apparatus of claim 1, wherein the means to discharge snow from the inflatable structure comprises means selected from the group of compressed air means, pump means, gravity means and any combination thereof.

14. The apparatus of claim 1, further comprising a releasable seal, wherein the releasable seal comprises:

a retractable cylinder that is externally engaged with the inflatable structure; and a shut-off valve.

15. The apparatus of claim 1, wherein the inflatable structure further comprises an inflatable bladder seal.

16. An apparatus to produce snow using a coolant to freeze water, comprising:

at least one water-holding container connected a source of water, wherein the container comprises flexible walls having inner surfaces and outer surfaces, wherein the outer surfaces are in contact with the coolant to freeze the water held in the container to form snow; and an air supply connected to the interior of the water-holding container, wherein the air supply is operable to flex the walls of the water-holding container to release formed snow from the inner wall surfaces.

17. The apparatus of claim 16 wherein the air supply comprises a source of compressed air and wherein the water-holding container further comprises a bleeding means to bleed compressed air from the water-holding container to flex the walls.

18. The apparatus of claim 16 wherein the water-holding container comprises a releasable seal that opens under the action of compressed air to discharge the contents of the container.

19. The apparatus of claim 16 further comprising a vessel to contain the coolant.

20. A method for making snow comprising the steps of:

(a) at least partially filling an inflatable structure with a quantity of water, wherein the inflatable structure is disposed in a cooling medium, wherein the inflatable structure comprises a wall having inner surfaces and outer surfaces, and wherein an outer surface is in contact with the coolant;

(b) allowing heat transfer from the quantity of water to the cooling medium across the wall to form ice crystals on the inner surfaces of the wall; and (c) mechanically manipulating the wall by applying an inflating force through the interior of the inflatable structure, whereby the formed ice crystals are released from the inner surfaces of the wall.

21. The method of claim 20 wherein applying the inflating force through the interior of the inflatable structure comprises introducing air into the inflatable structure to inflate and deflate the inflatable structure.

22. The method of claim 21 wherein introducing air into the inflatable structure comprises cyclically increasing and decreasing the pressure in the inflatable structure.

23. The method of claim 22 wherein cyclically increasing and decreasing the pressure in the inflatable structure comprises pumping compressed air in and evacuating air out of the inflatable structure.

24. The method of claim 20 wherein mechanically manipulating the wall comprises continuous flexing of the walls of the inflatable structure.

25. The method of claim 20 further comprising maintaining the cooling medium at no higher than a preset temperature.

26. The method of claim 20 wherein the steps (b) and (c) are repeated until substantially all of the quantity of water has been converted to snow.

27. The method of claim 20 further comprising the step of:

(d) discharging the ice crystals from the inflatable structure.

28. The method of claim 27, wherein the step (d) comprises:

opening an end of the inflatable structure; and introducing compressed air into the inflatable structure to push the ice crystals through the opened end.

29. The method of claim 20 further comprising using computer-controlled means for the operation of the method steps.

* * * * *